US007702259B2

(12) United States Patent
Eun et al.

(10) Patent No.: US 7,702,259 B2
(45) Date of Patent: Apr. 20, 2010

(54) MULTI-PASS IMAGE FORMING APPARATUS AND IMAGE FORMING METHOD USING THE SAME FOR PROVIDING PLURAL PRINT MODES WITH DIFFERENT NUMBERS OF PASSES DEPENDING ON DESIRED PRINT SPEED AND IMAGE QUALITY

(75) Inventors: Jong-moon Eun, Suwon-si (KR); Hisao Okada, Suwon-si (KR); Hyun-cheol Lee, Suwon-si (KR); Won Choe, Yongin-si (KR); Hyun-wook Bae, Yongin-si (KR); Won-wook Lee, Seoul (KR); So-won Sheen, Seoul (KR); In-cheol Jeon, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 497 days.

(21) Appl. No.: 11/441,057

(22) Filed: May 26, 2006

(65) Prior Publication Data

US 2006/0285883 A1 Dec. 21, 2006

(30) Foreign Application Priority Data

Jun. 15, 2005 (KR) ..... 10-2005-0051257

(51) Int. Cl.
*G03G 15/01* (2006.01)

(52) U.S. Cl. ..... 399/223; 399/232

(58) Field of Classification Search ..... 399/223, 399/231, 232
See application file for complete search history.

(56) References Cited

U.S. PATENT DOCUMENTS 4,165,165 A * 8/1979 Iwami et al. ..... 399/178
5,357,317 A * 10/1994 Fukuchi et al. ..... 399/39
5,534,990 A * 7/1996 Harris ..... 399/223
5,557,393 A 9/1996 Goodman et al.
5,884,119 A 3/1999 Maruo et al.
6,067,102 A * 5/2000 Okano et al. ..... 347/131
6,201,595 B1 * 3/2001 Maess et al. ..... 355/40
6,352,806 B1 * 3/2002 Dalal ..... 430/45.4
6,498,910 B2 * 12/2002 Haneda ..... 399/51
6,516,175 B2 * 2/2003 Ogasawara ..... 399/298

(Continued)

FOREIGN PATENT DOCUMENTS

JP 10-063063 3/1998

(Continued)

*Primary Examiner*—Quana M Grainger
(74) *Attorney, Agent, or Firm*—Roylance, Abrams, Berdo & Goodman, L.L.P.

(57) ABSTRACT

Provided are a multi-pass image forming apparatus and an image forming method using the same. The multi-pass image forming apparatus includes a plurality of developers for forming a plurality of electrostatic latent images using toners having different polarities and colors in one development process and for forming a multi-color image in at least two development processes; an exposure unit for forming the plurality of the electrostatic latent images on a photosensitive medium; and an intermediate transferring unit for having a toner images transferred thereon from the photosensitive medium that overlap to form the multi-color image, wherein the toner image may overlap another toner image on the intermediate transferring unit.

14 Claims, 7 Drawing Sheets

U.S. PATENT DOCUMENTS 6,803,932 B2 * 10/2004 Itoh et al. ..... 347/112
2001/0021322 A1 * 9/2001 Tsuruya et al. ..... 399/223

FOREIGN PATENT DOCUMENTS

JP 2000231279 A * 8/2000
JP 2002031949 A * 1/2002
JP 2002091165 A * 3/2002
JP 2002148893 A * 5/2002
JP 2005227319 A * 8/2005

* cited by examiner

MULTI-PASS IMAGE FORMING APPARATUS AND IMAGE FORMING METHOD USING THE SAME FOR PROVIDING PLURAL PRINT MODES WITH DIFFERENT NUMBERS OF PASSES DEPENDING ON DESIRED PRINT SPEED AND IMAGE QUALITY

CROSS-REFERENCE TO RELATED PATENT APPLICATION

This application claims the benefit under 35 U.S.C. §119 (a) of Korean Patent Application No. 10-2005-0051257, filed on Jun. 15, 2005, in the Korean Intellectual Property Office, the entire disclosure of which is hereby incorporated by reference.

BACKGROUND OF THE INVENTION

1. Field of the Invention

The present invention relates to a multi-pass image forming apparatus and an image forming method using the same. More particularly, the present invention relates to a multi-pass image forming apparatus and an image forming method using the same, which can select a print mode in consideration of print speed and image quality.

2. Description of the Related Art

In a conventional image forming apparatus a digital image signal is received that corresponds to a desired image. An electrostatic latent image is then formed on a photosensitive medium by an exposing unit such as a laser scanning unit (LSU). The electrostatic latent image is then developed using a toner to form a toner image. The toner image is then transferred onto a recording medium. The toner image is then fixed onto the recording medium with high temperature and high pressure, thereby forming the desired image.

This image forming apparatus is typically classified as either a wet type image forming apparatuses or a dry type image forming apparatuses, according to the state of the toner and carrier. A wet type image forming apparatus is further classified as either an image forming apparatus having a one-component developer or an image forming apparatus having a two-component developer.

While the one-component developer supplies only the toner to form an image, the two-component developer supplies the carrier mixed with the toner to form an image. In the one-component developer, the toner is supplied to a photosensitive medium to form the toner image. The toner remaining on the surface of the photosensitive medium is then removed by a cleaning device such as cleaning blade and collected by a collecting device so that the toner can be reused.

Meanwhile, in the two-component developer, the carrier is not supplied to the photosensitive medium and collected. Instead, only the toner is supplied to the photosensitive medium to form the toner image. The toner remaining on the surface of the photosensitive medium is removed by a cleaning blade and collected by a collecting device so that the toner can be reused.

A multi-color image forming apparatus generally requires yellow (Y), magenta (M), cyan (C), and black (K) toners. Accordingly, the multi-color image forming apparatus requires four developers for adhering respective color toners to an electrostatic latent image. A development bias for adhering the toner to the photosensitive medium and a supplying bias for supplying the toner to a developing roller are applied to each of the developers. The development bias and supplying bias are high voltages of several hundreds or several thousands of volts.

Either a single-pass printing, which requires four exposure units and four photosensitive media or a multi-pass printing, which requires a single exposure unit and a photosensitive medium, may be employed in printing a multi-color image.

A single-pass multi-color image forming apparatus is mainly used in a high-speed multi-color image forming apparatus because it allows high-speed printing for both a monochromic image and a multi-color image. However, since the four exposure units and four photosensitive media are required, it is difficult to minimize a size of the apparatus and therefore has high manufacturing costs.

A multi-pass multi-color image forming apparatus includes a single photosensitive medium and a single exposure unit. In this apparatus, by repeatedly performing the exposing, developing, and transferring processes for each color so as to overlap each color on an intermediate transfer medium, a color toner image is formed on the intermediate transfer medium and then the color toner image is transferred and fixed onto a sheet of paper (S).

The multi-pass multi-color image forming apparatus requires a longer printing time for a multi-color image than that of the single-pass image forming apparatus. Also, it is difficult to perform color registration.

Accordingly, there is a need for an improved multi-color image forming apparatus that can select a print mode in consideration of print speed and image quality.

SUMMARY OF THE INVENTION

Exemplary embodiments of the present invention address at least the above problems and/or disadvantages and provide at least the advantages described below. Accordingly, an aspect of the present invention is to provide a multi-pass image forming apparatus and an image forming method using the same, which can select a print mode in consideration of print speed and image quality.

According to an aspect of an exemplary embodiment of the present invention, there is provided a multi-pass image forming apparatus including a plurality of developers for forming a plurality of electrostatic latent images using toners having different polarities and colors in one development process and for forming a multi-color image in at least two development processes; an exposure unit for forming the plurality of the electrostatic latent images on a photosensitive medium; and an intermediate transferring unit for having a toner image transferred thereon from the photosensitive medium that overlap to form the multi-color image.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

Figure 1:
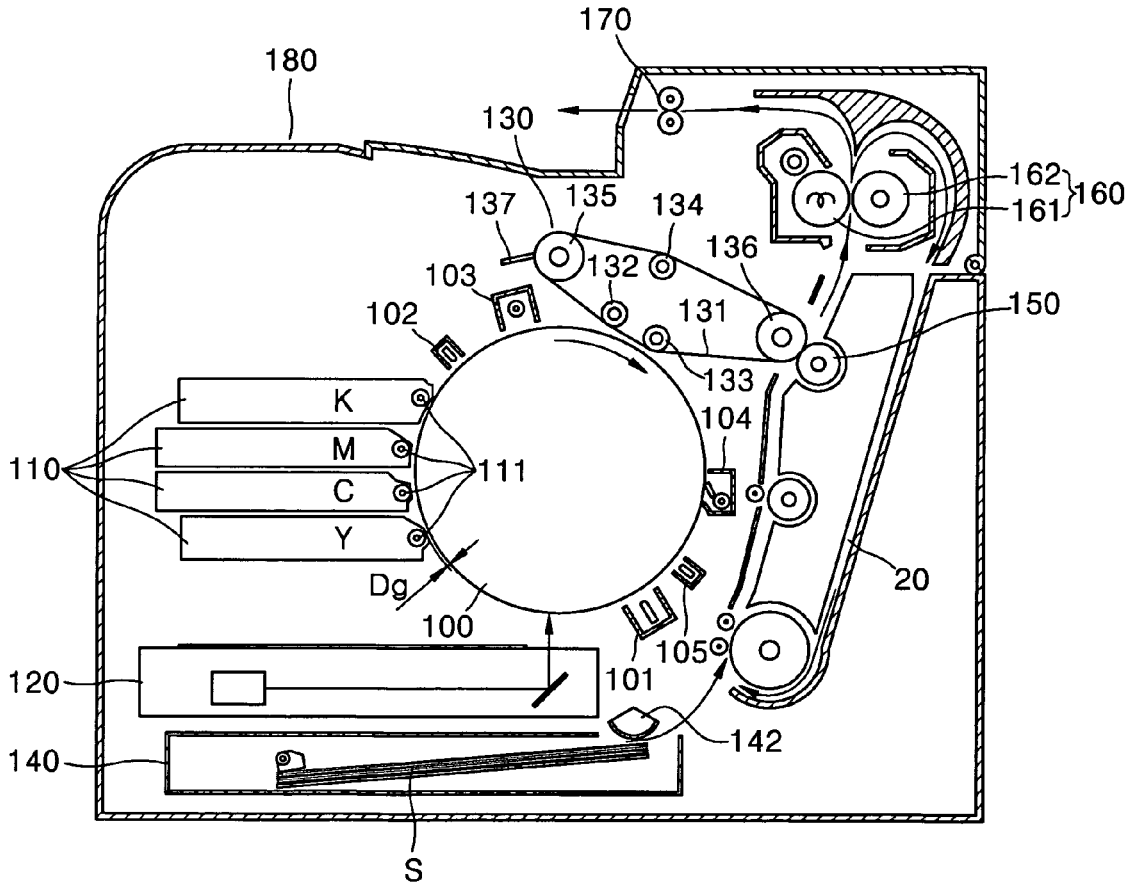
FIG. 1 is a diagram schematically illustrating a structure of a multi-pass image forming apparatus according to an exemplary embodiment of the present invention.

The matters defined in the description such as a detailed construction and elements are provided to assist in a comprehensive understanding of the embodiments of the invention and are merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness. FIG. 1 is a diagram schematically illustrating a structure of a multi-pass image forming apparatus according to a first exemplary embodiment of the present invention.

Referring to FIG. 1, the multi-pass image forming apparatus includes a photosensitive medium 100, a plurality of developers 110, an exposure unit 120, an intermediate transfer unit 130, a cassette 140, a transfer roller 150, a fixer 160, and an ejection unit 170.

The photosensitive medium 100 can be a cylindrical metal drum having a photoconductive layer formed on its outer circumferential surface and hereinafter, is referred to as a photosensitive drum.

A charging device 101, a pre-transfer eraser 102, a charging unit 103, a photosensitive drum cleaning unit 104, and a pre-charger eraser 105 are provided at the vicinity of the photosensitive medium 100.

The charging device 101 uniformly charges the photosensitive drum 100 and may include a charging roller or a corona charger. The charging device 101 supplies charge to the photosensitive drum 100 while rotating in contact with or in non-contact with the outer circumferential surface of the photosensitive drum 100, thereby resulting in the outer circumferential surface of the photosensitive drum 100 having a uniform potential.

The pre-transfer eraser 102 removes the charge from a non-image region of the photosensitive drum 100 before the toner image formed on the photosensitive drum 100 is transferred onto a transfer belt 131.

The charging unit 103 charges the photosensitive drum 100 in order to make the toners of different polarities and colors have a same polarity. Thereby, the toner image formed on the photosensitive drum 100 is transferred onto the intermediate transfer unit 130. The charging unit 103 is used for transferring the toner image onto the intermediate transfer unit 130 when forming a multi-color image using a two-pass mode. This will be described in detail later.

The photosensitive drum cleaning unit 104 removes the image remaining on the photosensitive drum 100 after transferring the toner image from the photosensitive drum 100 onto the intermediate transfer unit 130 and preferably includes a cleaning blade.

The pre-charger eraser 105 removes the charges from the entire surface of the photosensitive drum 100 before forming the toner image on the photosensitive drum 100.

The plurality of the developers 110 contain solid powdered toners of yellow Y, cyan C, magenta M, and black K, respectively, and are sequentially arranged in a rotational direction while facing the photosensitive drum 100. Each of the developers 110 include a development roller 111 for supplying each toner to an electrostatic latent image formed on the photosensitive drum 100 and form the toner image thereon. The plurality of the developers 110 are configured such that the development roller 111 is spaced from the outer circumferential surface of the photosensitive drum 100 by a development gap (Dg). It is preferable that the development gap be several tens or several hundreds of microns.

The exposure unit 120 is disposed below the photosensitive drum 100 and irradiates light onto the uniformly charged photosensitive drum 100 to form the electrostatic latent image.

The intermediate transfer unit 130 includes the transfer belt 131 and a plurality of supporting rollers 132, 133, 134, 135, and 136 for supporting and rotating the transfer belt 131. The transfer belt 131 faces the photosensitive drum 100 between the supporting roller 132 and the supporting roller 133 such that the toner image is transferred from the photosensitive drum 100 onto the transfer belt 131.

Furthermore, the intermediate transfer belt 130 includes a cleaning means 137 which contacts the surface of the transfer belt 131 and removes waste toner remaining on the surface of the transfer belt 131 after the toner image is transferred onto a sheet of paper (S). It is preferable that the cleaning means 137 is a cleaning blade.

The supporting roller 136 faces the transfer roller 150 through the transfer belt 131.

It is preferable that a linear travel speed of the transfer belt 131 is the same as a linear rotating speed of the photosensitive drum 100. A length of the transfer belt 131 should be the same or longer than a length of the sheet (S) on which a multi-color toner image is finally formed.

The transfer roller 150 is opposite to and faces the transfer belt 131. While the multi-color toner image is being transferred to the transfer belt 131 from the photosensitive drum 100 onto the transfer belt 131, the transfer roller 150 is spaced apart from the transfer belt 131. When the multi-color toner image is completely transferred onto the transfer belt 131, the transfer roller 150 contacts the transfer belt 131 with a predetermined pressure to transfer the multi-color toner image onto the sheet of paper (S).

The fixer 160 includes a heating roller 161 for generating heat and a pressurizing roller 162 for pressurizing the sheet (S) toward the heating roller 161 with a predetermined pressure while rotating in the state of facing the heating roller 161, thereby fixing the color toner image onto the sheet (S) by heat and pressure. Instead of the pressurizing roller 162, a heating roller may be used.

The ejection unit 170 includes a pair of rollers and ejects the sheet (S) on which the color toner image is fixed. The sheet (S) ejected from the ejection unit 170 is loaded in a sheet loading tray 180.

The cassette 140 loads the sheet (S) and is detachably provided in a main body 180. A pickup roller 142 for picking up the sheet (S) one by one is disposed above the cassette 140.

Reference numeral 20 denotes a duplex conveying unit for conveying the sheet (S) having the image formed on one surface thereof so as to print the images on both surfaces of the sheet (S).

The multi-pass image forming apparatus according to the present embodiment can select a plurality of print modes such as a two-pass mode, a three-pass mode, and a four-pass mode.

A user can select a desired print mode from the plurality of print modes based on the consideration of print speed and image quality.

For example, the four-pass mode is applied to a general multi-pass image forming apparatus. In this mode, the electrostatic latent images are sequentially developed to a single color using four color toners, and the toner images are transferred onto the transfer belt 131 and overlap, thereby forming the multi-color image. This mode can be selected when high image quality is required.

In the two-pass mode, the electrostatic latent image is developed using the toners having different polarities and colors at one time in order to form a desired multi-color image in two passes, thereby accomplishing a print speed that is two times faster than that the four-pass mode.

The three-pass mode is a modification of the two-pass mode. In this mode, the toners having different polarities and colors are supplied in a first pass. The same toners as those of the first pass are then supplied in a second pass. In a third pass, the toners having colors different from that of the toners of the second pass are supplied, thereby forming the multi-color image. This three-pass mode has a 30 percent or more increase in print speed over the four-pass mode and has better image quality than the two-pass mode.

Here, in a single pass, operations are performed to form the toner image of (1) charging the photosensitive drum, (2) performing the exposure, (3) developing the toner image, (4) transferring the toner image onto the transfer belt, and (5) cleaning the photosensitive drum. Accordingly, in the two-pass mode, a single pass is repeatedly performed two times to form a desired multi-color image.

First, the two-pass mode will be described. The operations of the single pass will be sequentially described.

(1) The photosensitive drum 100 is charged to a predetermined potential by the charging device 101. Here, the potential charged on the entire photosensitive drum 100 is referred to as a surface potential $V_0$. In the present embodiment, the surface potential $V_0$ is −900 V to −1000 V, and is preferably −950 V.

(2) The electrostatic latent image is formed on photosensitive drum 100 that is charged to the surface potential $V_0$ by the exposure unit 120.

In this mode, a plurality of the electrostatic latent images, which can be developed by the toners having different polarities and colors, must be formed in the single pass. For this, the exposure unit 120 controls the potential level of one light source by three levels to form a plurality of electrostatic latent images on the photosensitive drum.

Figure 2:
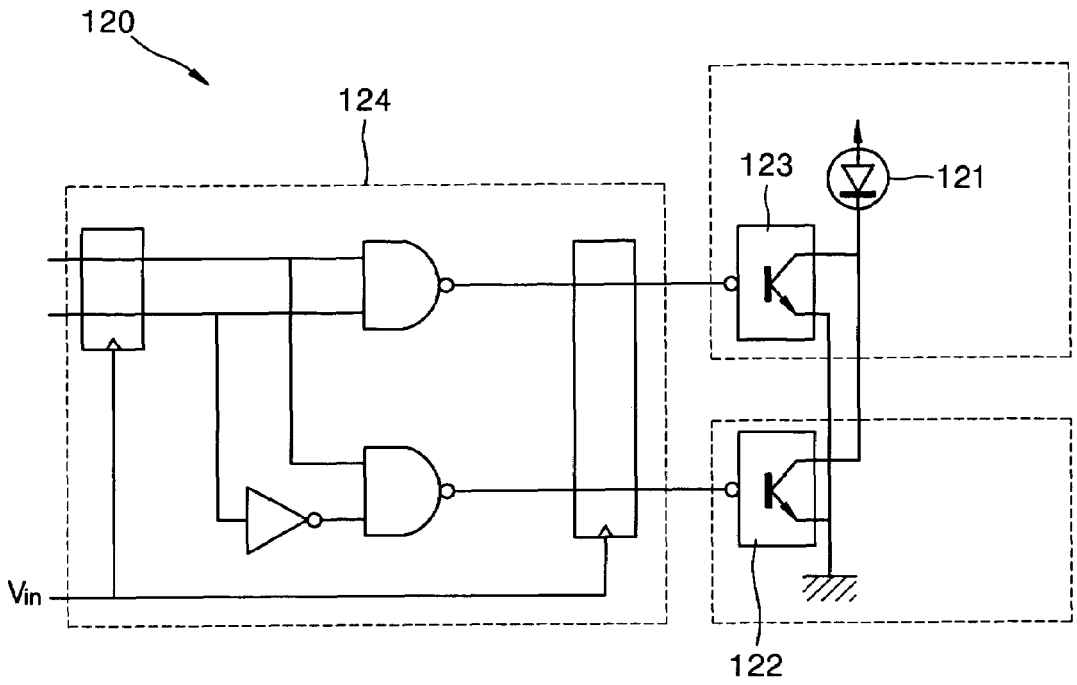
FIG. 2 illustrates a structure of an exposure unit and a control method according to the exemplary embodiment of the present invention of FIG. 1.
Figure 3:
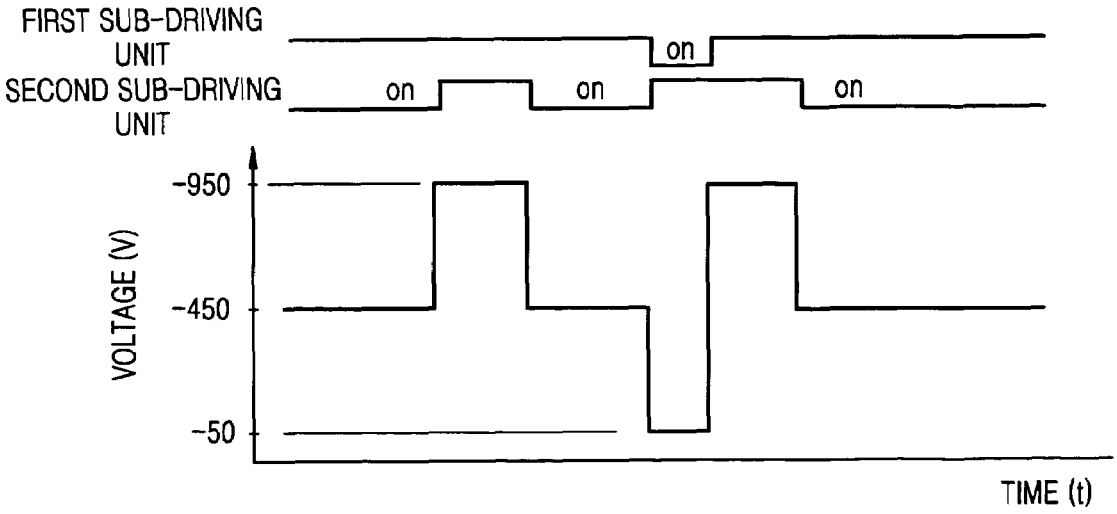
FIG. 3 is a graph illustrating a voltage potential charged on a photosensitive drum by control of the exposure unit shown in FIG. 2.

FIG. 2 illustrates a structure of the exposure unit and a control method according to the first exemplary embodiment of the present invention, and FIG. 3 is a graph illustrating the potential charged on the photosensitive drum by control of the exposure unit shown in FIG. 2.

Referring to FIGS. 2 and 3, the exposure unit 120 includes a light emitting unit 121, a first sub-exposure unit 122 and a second sub-exposure unit 123 for driving the light emitting unit 121. Further included is a control unit 124 for selectively turning on/off the first sub-driving unit 122 and the second sub-driving unit 123.

The exposure unit 120 can be controlled to have three levels including a first level in which only the first sub-driving unit 122 is turned on so as to charge the photosensitive drum 100 to a latent image potential $V_k$ by which the toner image can be formed using the toner having negative (−) charges. For the second level, only the second sub-driving unit 123 is turned on so as to charge the photosensitive drum 100 to a non-latent image potential $V_{md}$ by which the toner image is not formed. For the third level, both the first sub-driving unit 122 and the second sub-driving unit 123 are turned off so as to maintain the photosensitive drum 100 at the surface potential $V_0$ by which the toner image is formed using the toners having positive (+) charges.

Here, it is preferable that the absolute values of the surface potential $V_0$, the non-latent image potential $V_{md}$, and the latent. image potential $V_1$ satisfy the relationship of: | surface potential $V_0$|>| non-latent image potential $V_{md}$|>| latent image potential $V_1$|. For example, the surface potential $V_0$ is −950 V, the non-latent image potential $V_{md}$ is −400 V to −500 V and preferably −450 V, and the latent image potential $V_1$ is −30 V to −150 V and preferably −50 V.

Accordingly, the photosensitive drum 100 is exposed by the light irradiated from the exposure unit 120 to have three-level potentials corresponding to an image region in which the image is formed by two colors having different polarities and a non-image region in which the image is not formed.

(3) At the time of the single pass, the color toners transferred from the development roller 111 to the photosensitive drum 100 are any two of the four color toners of yellow (Y), cyan (C), magenta (M), and black (K).

In this case, the two colors should necessarily have different polarities. That is, the two colors must not have a same polarity.

For example, the plurality of the developers shown in FIG. 1 contain the toners of yellow (Y), cyan (C), magenta (M), and black (K), respectively, and yellow (Y) and magenta (M) may have a positive polarity and cyan (C) and black (K) may have a negative polarity.

Accordingly, at the time of the single pass, two colors having different polarities, that is, yellow (Y) and cyan (C), magenta (M) and black (K), yellow (Y) and magenta (M), and cyan (C) and black (K) may be selected.

The principle of transferring toners having the different polarities onto the photosensitive drum 100 to develop the electrostatic latent image will be described with reference to the accompanying drawings.

Figure 4:
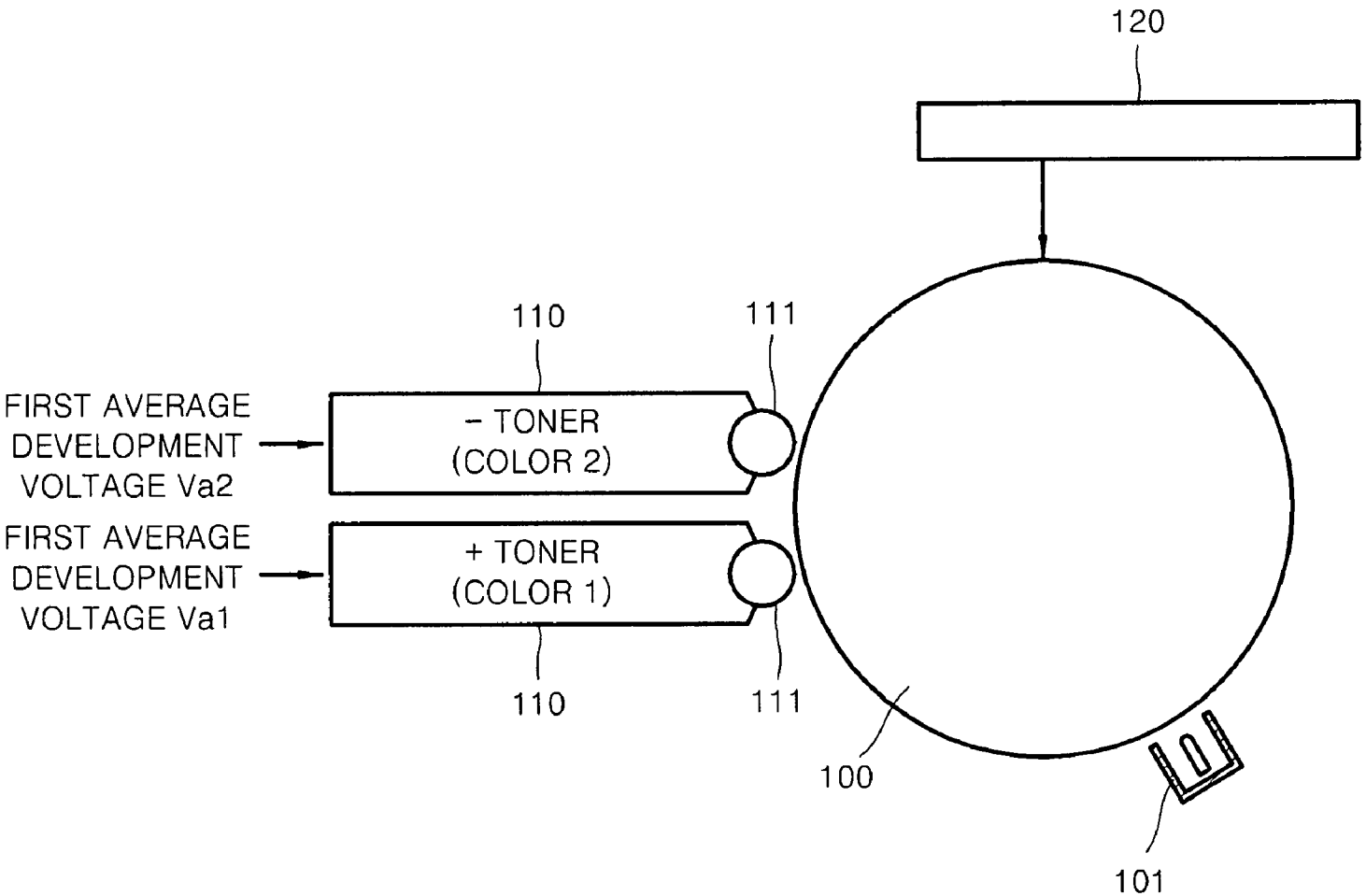
FIG. 4 illustrates a state in which two developers having toners of different polarities and colors are selected.
Figure 5:
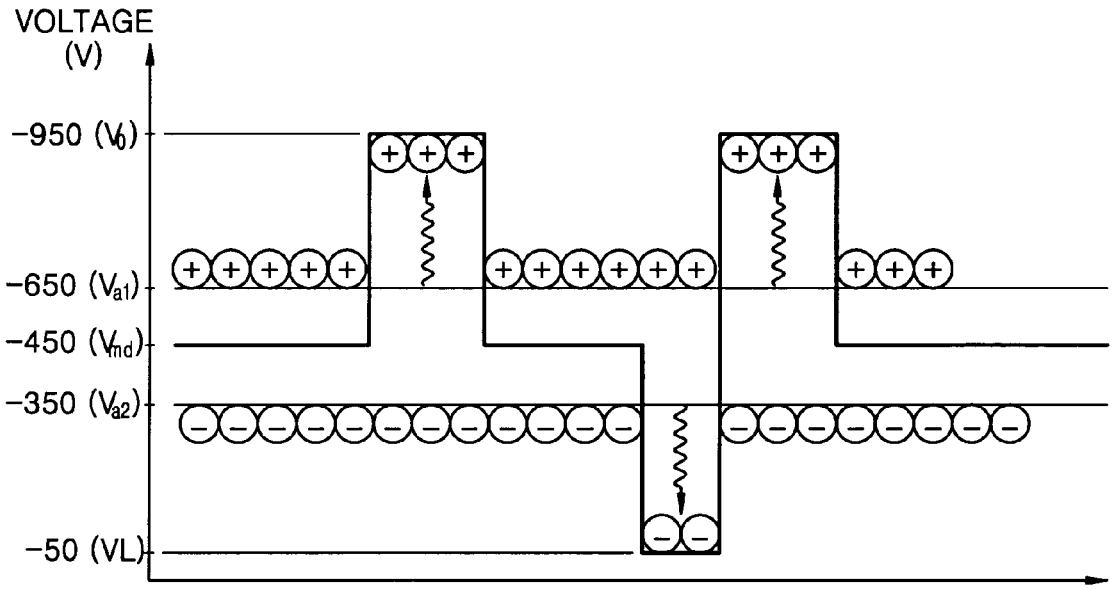
FIG. 5 is a schematic diagram illustrating development principle using a two-pass mode.

FIG. 4 illustrates a state in which two developers having toners with different polarities and colors are selected, and FIG. 5 is a schematic diagram illustrating a development principle using the two-pass mode.

Referring to FIGS. 4 and 5, the toner having the positive polarity (+) (for example, yellow (Y) or magenta (M)) is transferred from the development roller 111 onto the photosensitive drum 100 by the electrostatic development in order to develop the electrostatic latent image, thereby forming the toner image.

First, the toner having the positive polarity is transferred onto the image region of the photosensitive drum 100 charged to the surface potential $V_0$ using the exposure unit 120 controlled by the third level.

At this time, it is preferable that the development condition satisfies the following condition:

$$|\text{surface potential } V_0| > |\text{first average development potential } V_{a1}| > |\text{non-latent image potential } V_{md}|$$

Here, the first average development potential $V_{a1}$ denotes a voltage applied to the toner having the positive polarity (+).

For example, if the surface potential $V_0$ is −950 V, the first average development potential $V_{a1}$ is −650 V, and the non-latent image potential $V_{md}$ is −450V, the yellow toner from the development roller 111 which has the positive polarity (+) is attracted to the image region of the photosensitive drum 100 that is charged to the surface potential $V_0$ because of a difference between the first average development potential $V_{a1}$ and the surface potential $V_0$. However, between the first average development potential $V_{a1}$ and the non-latent image potential $V_{md}$, a force is exerted from the photosensitive drum 100 to the development roller 111, so that the yellow toner which has the positive polarity (+) does not move.

Accordingly, the image region charged to the surface potential $V_0$ is developed with the yellow toner having the positive polarity (+). Here, it is preferable that the first average development potential $V_{a1}$ is an overlap voltage between a DC voltage and an AC voltage.

Next, the toner having the negative polarity (for example, cyan (C) or black (K)) is transferred from the developer 110 onto the photosensitive drum 100 by the inverted development manner in order to form the toner image.

The toner having the negative polarity (−) is transferred onto the image region of the photosensitive drum 100 charged to the latent image potential $V_1$ using the exposure unit 120 having the first level.

At this time, if the potential applied to the toner having the negative polarity (−) is denoted by a second average development potential $V_{a2}$, it is preferable that the development condition satisfies:

$$|\text{surface potential } V_0| > |\text{non-latent image potential } V_{md}| > |\text{second average development potential } V_{a2}| > |\text{latent image potential } V_1|.$$

For example, if the surface potential $V_0$ is −950 V, the second average development potential $V_{a2}$ is −350 V, the non-latent image potential $V_{md}$ is −450V, and the latent image potential $V_1$ is −50 V, the cyan (C) toner which has the negative polarity (−) does not move into the non-image region. This is because an electric force reacting with the non-image region having the non-latent image potential $V_{md}$ generates a large reaction force toward the development roller 111. However, the cyan (C) toner which has the negative polarity (−) moves into the image region having the latent image potential to develop the electrostatic latent image. This is because an electric force reacting with the image region having the latent image potential $V_1$ generates a large reaction force toward the photosensitive drum 100.

Accordingly, the image region charged to the latent image potential $V_1$ is developed using cyan toner having the negative polarity (−). Here, it is preferable that the second average development potential $V_{a2}$ is an overlap voltage between a DC voltage and an AC voltage.

As the result, the image region charged to the surface potential $V_0$ is developed using the toner having the positive polarity (+), the image region charged to the latent image potential $V_1$ is developed using the toner having the negative polarity (−), and the non-image region charged to the non-latent image potential $V_{md}$ is not developed.

(4) The plurality of the toner images formed by the toners having the different polarities and colors are transferred from the photosensitive drum 100 onto the transfer belt 131 using an attractive force between the photosensitive drum 100 and the transfer belt 131. Here, the transfer of the toner image from the photosensitive drum 100 onto the transfer belt 130 is referred to as a first transfer.

That is, when a negative voltage is applied to the transfer belt 131, the toner image developed on the photosensitive drum 100 has the positive polarity (+).

However, since the toner image having the negative polarity (−) and the toner image having the positive polarity (+) exist on the photosensitive drum 100 together, the toner image having the positive polarity (+) can be transferred from the photosensitive drum 100 onto the transfer belt 131, but the toner image having the negative polarity (−) can not transferred.

Accordingly, a positive voltage is applied to the charging unit 103 to generate corona discharge. The toners having different polarities are unified to the toners having the positive polarity (+) due to movements of ions generated during the corona discharge. This is referred to as unification of the toner polarity.

Accordingly, a negative voltage is applied to the intermediate transfer unit 130 so that the toners having the positive polarity (+) are transferred from the photosensitive drum 100 onto the transfer belt 131.

Although the toners having different polarities are unified to the toners having the positive polarity (+), the toners having different polarities may be unified to the toners having the negative polarity (−).

(5) The toner image is not completely transferred from the photosensitive drum 100 onto the transfer belt 131, and a portion of the toner image remains on the surface of the photosensitive drum 100. The remaining toner image must be removed, because it may generate a fault in the next developing process.

The photosensitive drum cleaning unit 104 removes the toner image remaining on the surface of the photosensitive drum 100 and the removed toner image may be collected to be stored or reused.

The first pass is completed by the aforementioned process.

When the first pass is completed, the same process is repeated to perform the second pass. At this time, the toners for developing the electrostatic latent image are the toner having different polarities and colors, which are not used in the first pass. When the second pass is completed, the multi-color image is formed on the transfer belt 131.

After this multi-color image is transferred onto the sheet (S), the multi-color image is fixed onto the sheet (S) by the fixer 160 and the sheet (S) is ejected by the ejection unit 170. Thus, formation of the multi-color image is completed. The transfer of the multi-color image from the intermediate transfer unit 130 onto the sheet (S) is referred to as a second transfer.

Next, the three-pass mode will be described. In the three-pass mode, the single pass is performed three times to form the multi-color image. The first pass described above is repeatedly performed.

When the multi-color image is formed using the two-pass mode, color concentration of any one of secondary colors of red (R), green (G), and blue (B), which are not overlapped with the primary colors, may be deteriorated.

Accordingly, the three-pass mode can improve the image quality by adding one pass to the two-pass mode and overlapping all three colors of cyan, magenta, and yellow.

Accordingly, in the three-pass mode, the same colors are repeatedly used in the first pass and the second pass. By repeatedly overlapping the same colors, color definition increases and thus the image quality is improved.

Accordingly, the three-pass mode has a print speed slower than that of the two-pass mode, but has better image quality than that of the two-pass mode. The operations performed in every pass are described above and thus their detailed description will be omitted.

Furthermore, the four-pass mode will be described. In the four-pass mode, the single pass is performed four times to form the multi-color image. The single pass described above is performed in every pass.

But, in the four-pass mode, the toner image is formed using one toner in the respective pass and is transferred and overlapped to form the multi-color image. At this time, each toner has the polarity and color described above.

In the first transfer process in which the toner is transferred from the photosensitive drum 100 onto the intermediate transfer unit 130, when the polarity of the toner is equal to that of the applied voltage or when the charging amount of the toner need not be adjusted, the process of unifying the polarity of the toner may be omitted.

That is, in the two-pass mode, while the polarity of the toner is converted into the positive polarity (+), if the polarity of the toner is the positive polarity (+), this process may be omitted.

Figure 6:
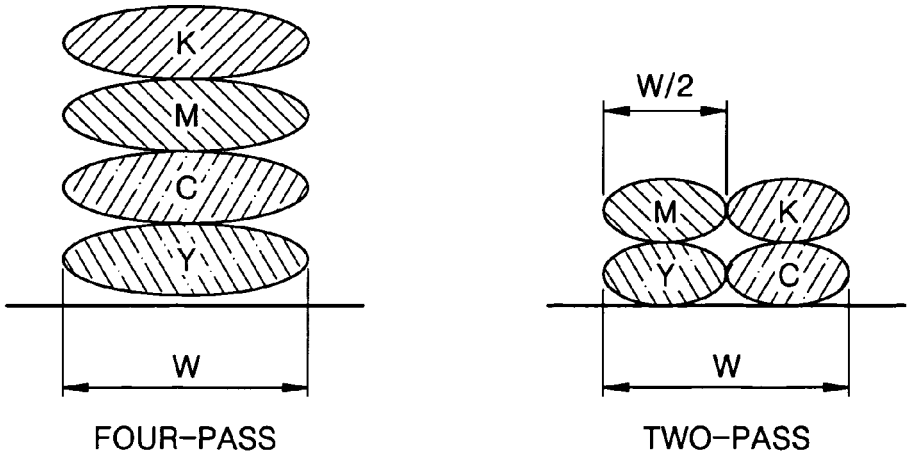
FIG. 6 illustrates a method of forming a multi-color image in a two-pass mode and a four-pass mode.

FIG. 6 illustrates a method of forming a multi-color image in two-pass mode and four-pass mode.

Referring to FIG. 6, in the four-pass mode, since the multi-color image is formed by overlapping the four colors, the four colors are overlapped and mixed onto one another to form the multi-color image and thus the quality of the multi-color image is high.

On the other hand, in the two-pass mode and the three-pass mode, the toners having the different colors and polarities are located in parallel and the toners having the other colors are located thereon in parallel to be mixed one another so that the multi-color image is formed.

At this time, since a width (W/2) of each toner in the two-pass mode is a half of a width (W) of each toner in the four-pass mode, the amount of the toner consumed when forming an image having the same width (W) can be reduced.

Figure 7:
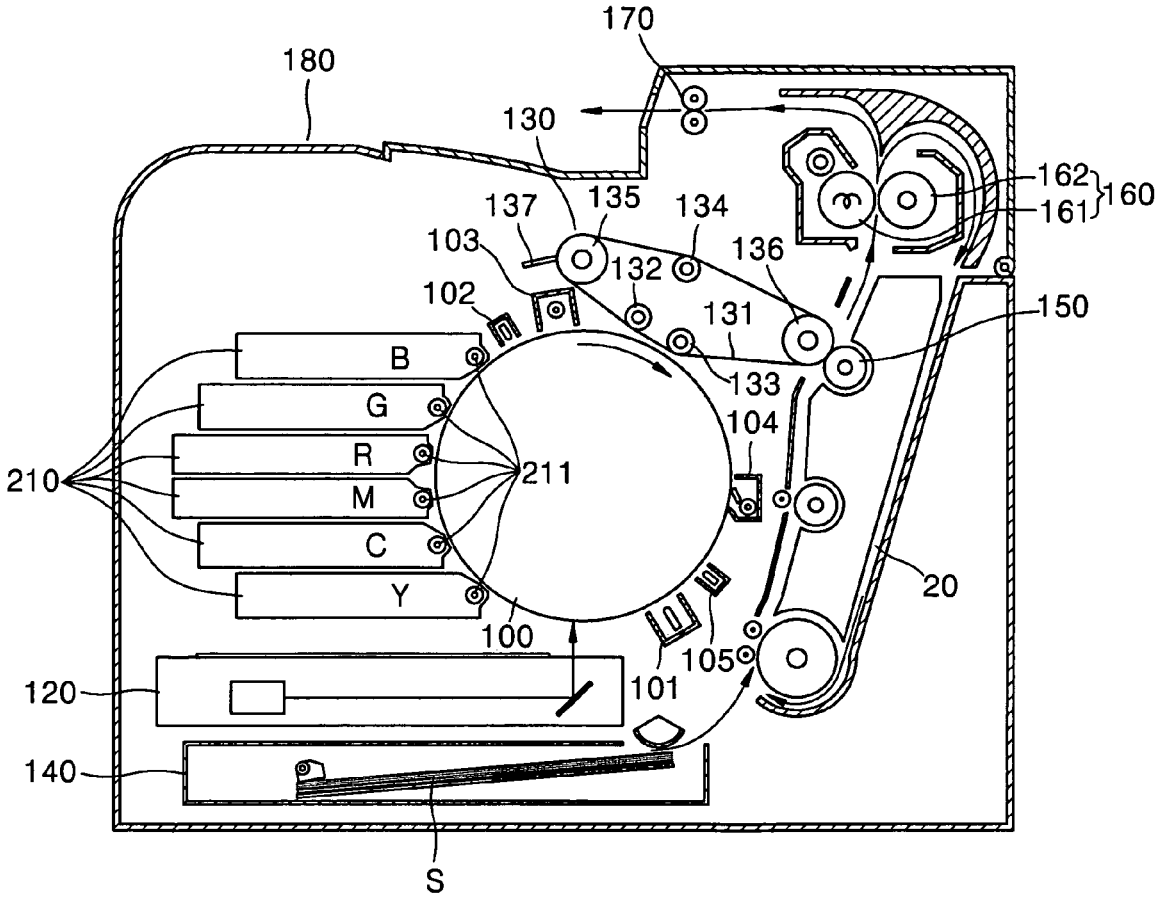
FIG. 7 is a diagram schematically illustrating a structure of a multi-pass image forming apparatus according to another exemplary embodiment of the present invention.

FIG. 7 is a diagram schematically illustrating a structure of a multi-pass image forming apparatus according to a second exemplary embodiment of the present invention.

Referring to FIG. 7, the multi-pass image forming apparatus of the present embodiment is equal to that of the first embodiment shown in FIG. 1 except for the structure of the developer. The same reference numerals as those shown in FIG. 1 denote the same members having the same functions and thus their descriptions will be omitted.

A plurality of developers 210 contain six color toners including the primary colors of yellow (Y), cyan (C), and magenta (M) and secondary colors of red (R), green (G), and blue (B), respectively. Each color toner has a positive polarity (+) or a negative polarity (−). When the toner image is formed using the two-pass mode, the toners transferred from a development roller 211 onto the photosensitive drum 100 must have different polarities as mentioned above.

In the present embodiment, the multi-color image can be formed using the two-pass mode, the three-pass mode, or the six-pass mode. When the user selects any one of the plurality of the pass modes, the relationship between the print speed and the image quality can be considered.

Figure 8:
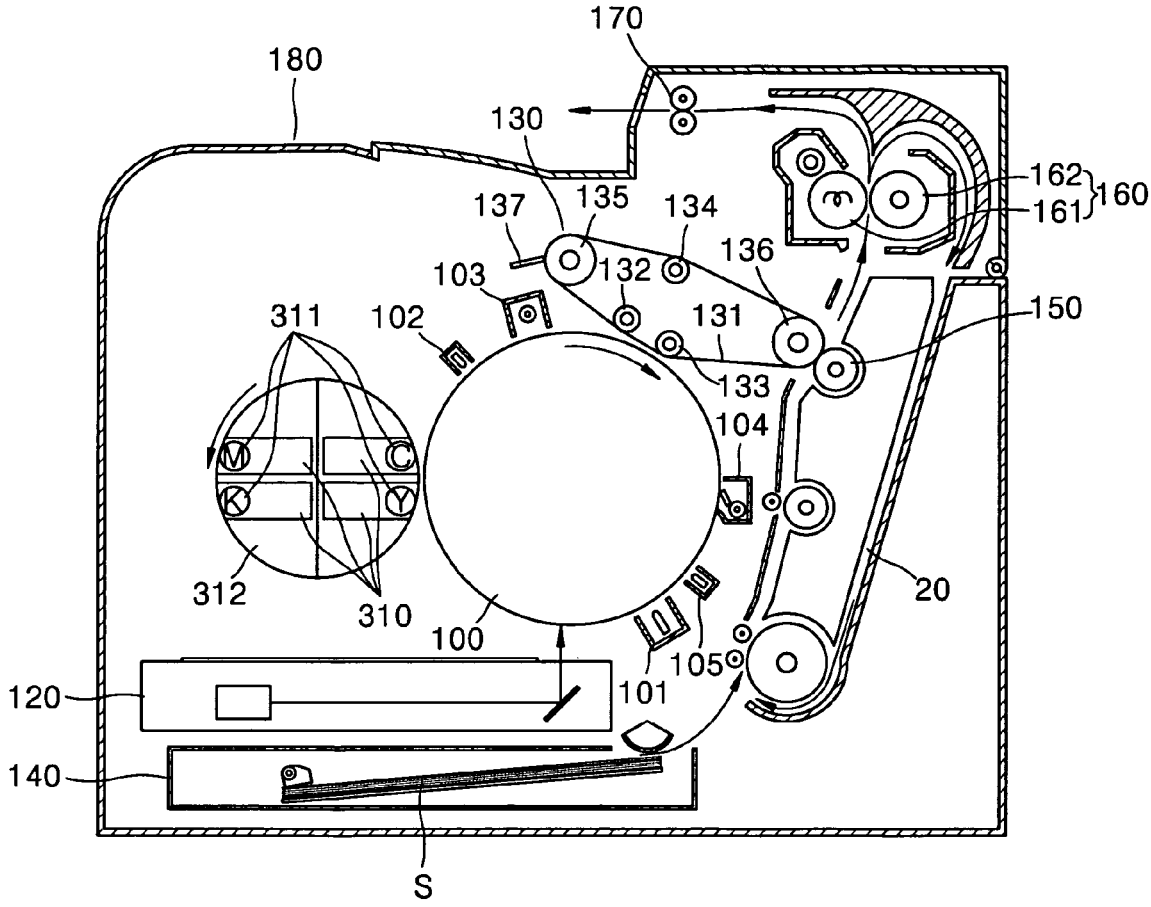
FIG. 8 is a diagram schematically illustrating a structure of a multi-pass image forming apparatus according to another exemplary embodiment of the present invention.

FIG. 8 is a diagram schematically illustrating a structure of a multi-pass image forming apparatus according to a third exemplary embodiment of the present invention.

Referring to FIG. 8, the multi-pass image forming apparatus according to the present embodiment is equal to that of the first embodiment shown in FIG. 1 except for the structure of the developer. The same reference numerals as those shown in FIG. 1 denote the same members having the same functions and thus their descriptions will be omitted.

A plurality of developers 310 are grouped two by two and are provided so as to face each other in a location control unit 312. For example, one group includes yellow (Y) and cyan (C) and the other group includes magenta (M) and black (K).

The color toners contained in the grouped developers 310 have different polarities. When the multi-color image is formed by the two-pass mode or the three-pass mode, the location control unit 312 rotates in the direction indicated by an arrow in order to change the location of the developers 310 so that development rollers 311 of the grouped developers 310 in turn face the photosensitive drum 100 in the respective pass.

The operations performed in every pass are described above and thus their description will be omitted.

Figure 9:
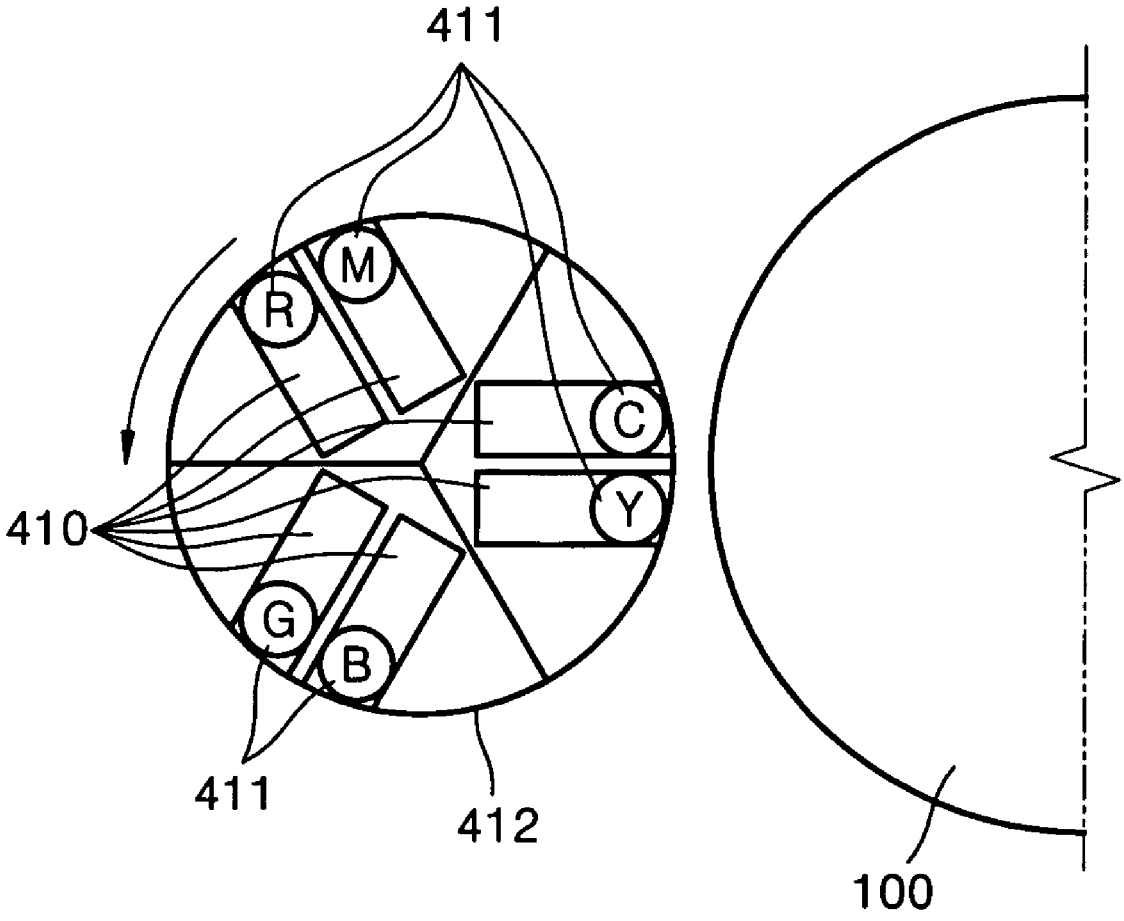
FIG. 9 is a modified example of a developer for use with the multi-pass image forming apparatus shown in FIG. 8.

FIG. 9 is a modified example of the developer of the third embodiment shown in FIG. 8.

Referring to FIG. 9, a plurality of developers 410 including the primary colors of yellow (Y), cyan (C), and magenta (M) and secondary colors of red (R), green (G), and blue (B) are grouped two by two and are provided in allocation control unit 412 at a predetermined interval.

In the present exemplary embodiment, the developers 410 are grouped into yellow (Y) and cyan (C), magenta (M) and red (R), and green (G) and blue (B). However, the this exemplary embodiment of the present invention is not limited to this as the developers may be grouped in the other manners. At this time, the grouped color toners must have different polarities.

The location control unit 412 rotates in a direction indicated by an arrow in order to change the locations of the developers 410 so that the development rollers 411 of the grouped developers 410 in turn face the photosensitive drum 100 in the respective pass.

The operation performs in every pass is described above, and thus their description will be omitted.

As mentioned above, the multi-pass image forming apparatus according to the exemplary embodiments of the present invention have the following effects.

First, since the electrostatic latent image required for developing the plurality of the color toners can be formed using one light emitting unit, the number of the image forming processes can be reduced by half.

Second, since any print mode can be selected from the plurality of the print modes for forming the multi-color image, both the print speed and image quality can be improved.

Third, when the multi-color image is formed using the two-pass mode, the amount of the toner consumed can be reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. A multi-pass image forming apparatus comprising:

a photosensitive medium;

an exposure unit for forming a plurality of electrostatic latent images on the photosensitive medium;

a plurality of developers containing color toners of yellow, cyan, magenta and black, respectively and sequentially disposed to face the photosensitive medium for developing the plurality of electrostatic latent images using two toners having different polarities and colors in one development process and for forming a multi-color image in at least two development processes; and an intermediate transferring unit for having toner images transferred thereon from the photosensitive medium that overlap to form the multi-color image;

wherein the exposure unit includes a plurality of sub-driving units for selectively being turned on/off to charge the photosensitive medium to potentials corresponding to an image region onto which toners having different polarities and colors are transferred and a non-image region on which the image is not formed;

wherein the plurality of the sub-driving units includes a first sub-driving unit and a second sub-driving unit, wherein the first sub-driving unit is turned on to charge the photosensitive medium with a latent image potential $V_1$ by which the toner having a negative polarity can be transferred, and the second sub-driving unit is turned on to charge the photosensitive medium with a non-latent image potential $V_{md}$ by which the image is not formed, and both the first sub-driving unit and the second sub-driving unit are turned off to maintain the photosensitive medium with a surface potential $V_0$ by which the toner having a positive polarity can be transferred.

2. The apparatus according to claim 1, wherein any two developers selected from the plurality of the developers are brought into contact with the photosensitive medium to develop the plurality of the electrostatic latent images.

3. The apparatus according to claim 2, wherein the two developers contain toners having different polarities and colors, respectively.

4. The apparatus according to claim 1, further comprising a charging unit for making the toner images having different polarities formed on the photosensitive medium have a same polarity.

5. The apparatus according to claim 4, wherein the charging unit unifies the toner images having the different polarities into toner images having a positive polarity.

6. A multi-pass image forming apparatus comprising:

a plurality of developers for forming a plurality of electrostatic latent images using toners having different polarities and colors in one development process and for forming a multi-color image in at least two development processes;

an exposure unit for forming the plurality of the electrostatic latent images on a photosensitive medium; and an intermediate transferring unit for having toner images transferred thereon from the photosensitive medium that overlap to form the multi-color image;

wherein the plurality of developers contain the toners of different polarities and colors of yellow, cyan, magenta, red, green, and blue, and are sequentially transferred to face the photosensitive medium.

7. A multi-pass image forming apparatus comprising:

a plurality of developers grouped two by two for developing a plurality of electrostatic latent images using toners having different polarities and colors in one development process and for forming a multi-color image in at least two development processes by rotation;

an exposure unit for forming the plurality of the electrostatic latent images on a photosensitive medium;

an intermediate transferring unit for having toner images transferred thereon from the photosensitive medium that overlap to form the multi-color image; and a rotatable location control unit;

wherein the plurality of developers are grouped two by two so that one group has the toners of different polarities and different colors selected from yellow, magenta, cyan, red, blue, and green; and wherein the plurality of developers are mounted in the rotatable location control unit, and any two developers selected from the plurality of the developers face the photosensitive medium to develop the electrostatic latent images on the photosensitive medium by rotation of the location control unit.

8. The apparatus according to claim 7, wherein the plurality of the developers forming one group contain toners having different polarities and colors.

9. The apparatus according to claim 7, further comprising a charging unit for making the toner images having different polarities formed on the photosensitive medium have a same polarity.

10. The apparatus according to claim 9, wherein the charging unit unifies the toner images having the different polarities into toner images having a positive polarity.

11. A multi-pass image forming apparatus comprising:

a plurality of developers grouped two by two for forming a plurality of electrostatic latent images using toners having different polarities and colors in one development process and for forming a multi-color image in at least two development processes by rotation;

an exposure unit for forming the plurality of the electrostatic latent images on a photosensitive medium; and an intermediate transferring unit for having toner images transferred thereon from the photosensitive medium that overlap to form the multi-color image;

the exposure unit includes a plurality of sub-driving units for selectively being turned on/off to charge the photosensitive medium to potentials corresponding to an image region onto which toners having different polarities and colors are transferred and a non-image region on which the image is not formed;

wherein the plurality of the sub-driving units includes a first sub-driving unit and a second sub-driving unit;

wherein the first sub-driving unit is turned on to charge the photosensitive medium with a latent image $V_1$ by which the toner having a negative polarity can be transferred, and the second sub-driving unit is turned on to charge the photosensitive medium with a non-latent image potential $V_{md}$ by which the image is not formed, and both the first sub-driving unit and the second sub-driving unit are turned off to maintain the photosensitive medium with a surface potential V0 by which the toner having a positive polarity can be transferred.

12. In a multi-pass image forming apparatus comprising a plurality of pass print modes with each of the plurality of pass print modes comprising a different number of passes, a method of forming a multi-pass image comprising the steps of:

selecting a pass print mode from among the plurality of pass print modes for printing the multi-color image in consideration of the print speed and the image quality;

operating a plurality of developers facing a photosensitive medium so as to form a toner images on the photosensitive medium, according to the selected pass print mode; and transferring the toner images onto an intermediate transfer unit that overlap to print a multi-color image;

wherein if the selected pass print mode is a three-pass print mode, a plurality of electrostatic latent images are developed using a plurality of toners having different polarities and colors in a first pass, the plurality of the electrostatic latent images are developed using the plurality of the toners having the same polarities and colors as those of the first pass, and the plurality of the electrostatic latent images are developed using the plurality of the toners having polarities and colors different from those of the first pass in order to form the multi-color image.

13. A multi-pass image forming apparatus comprising:

a plurality of developers for forming a plurality of electrostatic latent images using toners having different polarities and colors in one development process and for forming a multi-color image in at least two development processes;

an exposure unit for forming the plurality of the electrostatic latent images on a photosensitive medium; and an intermediate transferring unit for having toner images transferred thereon from the photosensitive medium that overlap to form the multi-color image;

wherein the exposure unit includes a plurality of sub-driving units for selectively being turned on/off to charge the photosensitive medium to potentials corresponding to an image region onto which toners having different polarities and colors are transferred and a non-image region on which the image is not formed, and wherein the plurality of the sub-driving units includes a first sub-driving unit and a second sub-driving unit, and wherein the first sub-driving unit is turned on to charge the photosensitive medium with a latent image potential $V_1$ by which the toner having a negative polarity can be transferred, and the second sub-driving unit is turned on to charge the photosensitive medium with a non-latent image potential $V_{md}$ by which the image is not formed, and both the first sub-driving unit and the second sub-driving unit are turned off to maintain the photosensitive medium with a surface potential $V_0$ by which the toner having a positive polarity can be transferred.

14. A multi-pass image forming apparatus comprising:

a plurality of developers containing color toners of yellow, cyan, magenta, red, green and blue, respectively and sequentially disposed to face the photosensitive medium for forming a plurality of electrostatic latent images using two toners having different polarities and colors in one development process and for forming a multi-color image in at least two development processes;

an exposure unit for forming the plurality of the electrostatic latent images on a photosensitive medium; and an intermediate transferring unit for having toner images transferred thereon from the photosensitive medium that overlap to form the multi-color image.

* * * * *